US012241666B2

(12) United States Patent
Mei et al.

(10) Patent No.: US 12,241,666 B2
(45) Date of Patent: Mar. 4, 2025

(54) EVAPORATOR

(71) Applicants: York Guangzhou Air Conditioning and Refrigeration Co., Ltd., Qingyuan (CN); Johnson Controls Tyco IP Holdings LLP, Milwaukee, WI (US)

(72) Inventors: Lu Mei, Qingyuan (CN); Xiuping Su, Qingyuan (CN); Yao Yang, Qingyuan (CN); Jianping Peng, Qingyuan (CN)

(73) Assignees: York Guangzhou Air Conditioning and Refrigeration Co., Ltd., Qingyuan (CN); Tyco Fire & Security GmbH, Neuhausen am Rheinfall (CH)

( * ) Notice: Subject to any disclaimer, the term of this patent is extended or adjusted under 35 U.S.C. 154(b) by 99 days.

(21) Appl. No.: 18/018,247

(22) PCT Filed: Jun. 17, 2021

(86) PCT No.: PCT/CN2021/100572

§ 371 (c)(1),
(2) Date: Jan. 26, 2023

(87) PCT Pub. No.: WO2022/022144

PCT Pub. Date: Feb. 3, 2022

(65) Prior Publication Data

US 2023/0272950 A1 Aug. 31, 2023

(30) Foreign Application Priority Data

Jul. 29, 2020 (CN) ..... 202010743506.7

(51) Int. Cl.
*F25B 39/02* (2006.01)

(52) U.S. Cl.
CPC ..... *F25B 39/028* (2013.01); *F25B 2500/09* (2013.01)

(58) Field of Classification Search
CPC ..... F25B 39/028; F25B 2500/09; F28D 7/1607; F28F 9/0214; F28F 9/028; F28F 9/0265

(Continued)

(56) References Cited

U.S. PATENT DOCUMENTS 4,635,712 A 1/1987 Baker et al.
4,972,903 A * 11/1990 Kwok ..... F28D 7/06 165/158

(Continued)

FOREIGN PATENT DOCUMENTS

CN 101960238 A 1/2011
CN 103017423 A 4/2013

(Continued)

OTHER PUBLICATIONS

PCT International Search Report for PCT Application No. PCT/CN2021/100572, mailed Aug. 23, 2021, 3 pgs.

(Continued)

*Primary Examiner* — Jon T. Schermerhorn, Jr.
(74) *Attorney, Agent, or Firm* — Fletcher Yoder, P.C.

(57) ABSTRACT

The present application provides an evaporator, including a heat exchange tube set and a distribution device. The heat exchange tube set includes a plurality of heat exchange tubes. The distribution device is provided on one end of the length direction of the heat exchange tube set such that the distribution device can distribute a refrigerant through heat exchange tube inlets at the end portions of the plurality of heat exchange tubes. The distribution device includes a distribution device housing, at least one receiving port, and at least one distribution member. The receiving port is provided on the distribution device housing, and the distribution member is provided in the distribution device housing. The distribution device housing is disposed around the heat exchange tube inlets at the end portions of the heat (Continued)

exchange tube set and seals the heat exchange tube inlets. The distribution member can receive the refrigerant through the receiving port. The distribution member is provided with a plurality of distribution ports such that the refrigerant in the distribution member can be sprayed through the plurality of distribution ports towards the heat exchange tube inlets of the heat exchange tube set. The evaporator of the present application can uniformly distribute the refrigerant to the plurality of heat exchange tubes of the heat exchange tube set by using a simple structure, thereby effectively ensuring the heat exchange efficiency of the evaporator.

10 Claims, 7 Drawing Sheets

(58) Field of Classification Search
USPC ..... 165/175
See application file for complete search history.

(56) References Cited

U.S. PATENT DOCUMENTS

| | | | | |
|---|---|---|---|---|
| 5,645,124 | A * | 7/1997 | Hartfield | F28D 3/04 165/DIG. 175 |
| 5,836,382 | A * | 11/1998 | Dingle | F28F 9/0273 165/DIG. 402 |
| 6,382,313 | B2 | 5/2002 | Mitsumoto et al. | |
| 6,830,099 | B2 * | 12/2004 | Moeykens | F28D 3/02 62/84 |
| 9,310,143 | B2 * | 4/2016 | Valente | F28D 7/16 |
| 9,683,784 | B2 * | 6/2017 | Christians | F28D 3/02 |
| 10,209,013 | B2 * | 2/2019 | Schreiber | F25B 39/028 |
| 10,317,117 | B2 * | 6/2019 | Schreiber | F28D 21/0017 |
| 10,436,515 | B2 * | 10/2019 | Alahyari | F24F 1/0067 |
| 2001/0017202 | A1 * | 8/2001 | Mitsumoto | B01J 19/002 165/158 |
| 2008/0010829 | A1 | 1/2008 | Rohrbaugh et al. | |

FOREIGN PATENT DOCUMENTS

| | | | |
|---|---|---|---|
| CN | 205825508 | U | 12/2016 |
| CN | 206235232 | U | 6/2017 |
| CN | 206291776 | U | 6/2017 |
| CN | 112484346 | A | 3/2021 |
| DE | 3310236 | A1 | 9/1984 |
| WO | WO2020161761 | A1 * | 8/2020 |

OTHER PUBLICATIONS

European Extended Search Report for EP Application No. 21849879.8, dated Jul. 10, 2024, 7 pages.

* cited by examiner

EVAPORATOR

CROSS-REFERENCE TO RELATED APPLICATIONS

This application is a U.S. National Stage Application of PCT Application No. PCT/CN2021/100572, entitled "EVAPORATOR," filed Jun. 17, 2021, which claims priority to and the benefit of Chinese Patent Application No. 202010743506.7, filed Jul. 29, 2020, each of which is hereby incorporated by reference in its entirety for all purposes.

BACKGROUND

Technical Field

The present application relates to the field of evaporators, and particularly relates to a refrigerant distribution device in a dry type evaporator.

Related Art

An evaporator is a key component in a refrigeration system, and a dry type evaporator is a common type of evaporators. A plurality of heat exchange tubes are disposed in the dry type evaporator, a refrigerant flows inside the heat exchange tubes, and water flows outside the heat exchange tubes, so that the refrigerant in the heat exchange tubes and the water outside the heat exchange tubes can exchange heat inside an evaporator housing. In the heat exchange process, the refrigerant in the heat exchange tubes absorbs the heat of the water outside the heat exchange tubes to completely evaporate, thereby achieving the heat exchange function of the evaporator. Therefore, the heat exchange efficiency of the dry type evaporator can be effectively ensured through uniform distribution of the refrigerant in the heat exchange tubes. However, since there are many heat exchange tubes in the dry type evaporator, it is difficult to uniformly distribute the refrigerant into each heat exchange tube. Therefore, it needs to provide an evaporator capable of realizing the uniform distribution of the refrigerant in the plurality of heat exchange tubes in the evaporator.

SUMMARY

The purpose of the present application is to provide an evaporator capable of uniformly spraying a refrigerant into a plurality of heat exchange tubes in the evaporator by using a simple structure.

In order to achieve the above purpose, in one aspect, the present application provides an evaporator. The evaporator includes an evaporator housing, a tube plate, a heat exchange tube set and a distribution device. The evaporator housing has a length direction. The tube plate is connected to one end of the length direction of the evaporator housing. The heat exchange tube set includes a plurality of heat exchange tubes, and the heat exchange tube set is disposed in the evaporator housing. Each of the heat exchange tubes extends in the length direction of the evaporator housing and is provided with a heat exchange tube inlet penetrating through the tube plate. The distribution device is connected to the tube plate and configured to distribute a refrigerant to the heat exchange tube inlets. The distribution device includes a distribution device housing, at least one receiving port and at least one distribution member. The distribution device housing is internally provided with an accommodating space, and the distribution device housing is disposed around the heat exchange tube inlets and seals the heat exchange tube inlets. The at least one receiving port is configured to receive the refrigerant. Each of the distribution member is disposed in the accommodating space and includes a distribution accommodating cavity and a plurality of distribution ports communicating with the distribution accommodating cavity, the distribution accommodating cavity of each distribution member communicates with one corresponding receiving port, and the plurality of distribution ports are disposed towards the heat exchange tube inlets and have a certain distance from the heat exchange tube inlets.

According to the evaporator, the evaporator housing has a height direction and a width direction. The distribution member is a distribution tube, the distribution tube extends in the height direction of the evaporator housing, and the plurality of distribution ports are disposed at intervals in the extending direction of the distribution tube.

According to the evaporator, the plurality of distribution ports are formed by a plurality of cuts in the distribution tube, and each of the cuts extends in the peripheral direction of the distribution tube.

According to the evaporator, the plurality of distribution ports are formed by a plurality of spray nozzles disposed on the distribution tube, and each of the distribution ports extends in the width direction of the distribution tube.

According to the evaporator, an opening of the distribution port is formed in an obliquely upward direction such that the refrigerant in the distribution accommodating cavity is able to be sprayed out from the distribution port at an obliquely upward angle.

According to the evaporator, in the height direction of the evaporator housing, the distribution port in a higher position is closer to the heat exchange tube inlet than the distribution port in a lower position.

According to the evaporator, in the height direction of the evaporator housing, an opening size of the distribution port in a higher position is larger than an opening size of the distribution port in a lower position.

According to the evaporator, in the extending direction of the distribution tube, a distance between two adjacent distribution ports in higher positions is smaller than a distance between two adjacent distribution ports in lower positions.

According to the evaporator, the distribution device housing includes an end plate and an annular baffle plate. The at least one distribution member is disposed on an inner wall of the end plate, and the at least one receiving port penetrates through the end plate. The annular baffle plate is connected between the tube plate and the end plate, and the annular baffle plate forms the accommodating space together with the end plate.

According to the evaporator, the distribution device further includes a plurality of flow deflectors, and the plurality of flow deflectors are disposed between the tube plate and the at least one distribution member. The plurality of flow deflectors are disposed at intervals in the height direction of the evaporator housing. Each of the flow deflectors respectively extends in an obliquely upward direction from the tube plate, and an included angle between each of the flow deflectors and the horizontal direction is smaller than or equal to 15°.

According to the present application, the at least one distribution member is disposed in the distribution device, the refrigerant from an expansion valve can be pre-distributed in the length direction of the distribution member, and can be uniformly distributed into the heat exchange tube in a spraying manner. The distribution device of the present application has a simple structure, and is relatively easy to install and manufacture. Additionally, the distribution device of the present application reduces the requirement on the pressure drop of the refrigerant through pre-distribution, and the uniform distribution of the refrigerant is enabled to be realized under a low-pressure work condition.

DETAILED DESCRIPTION

Various embodiments of the present application will be described hereafter with reference to the accompanying drawings, which form a part of the description. It should be understood that although directional terms such as "front", "back", "upper", "lower", "left", "right" and the like are used herein to describe various exemplary structural portions and members of the present application, these terms are used herein for ease of description only and are determined based on the exemplary orientations shown in the figures. The embodiments disclosed herein may be disposed in different orientations, so these directional terms are merely illustrative and should not be considered as limitations.

Figure 1:
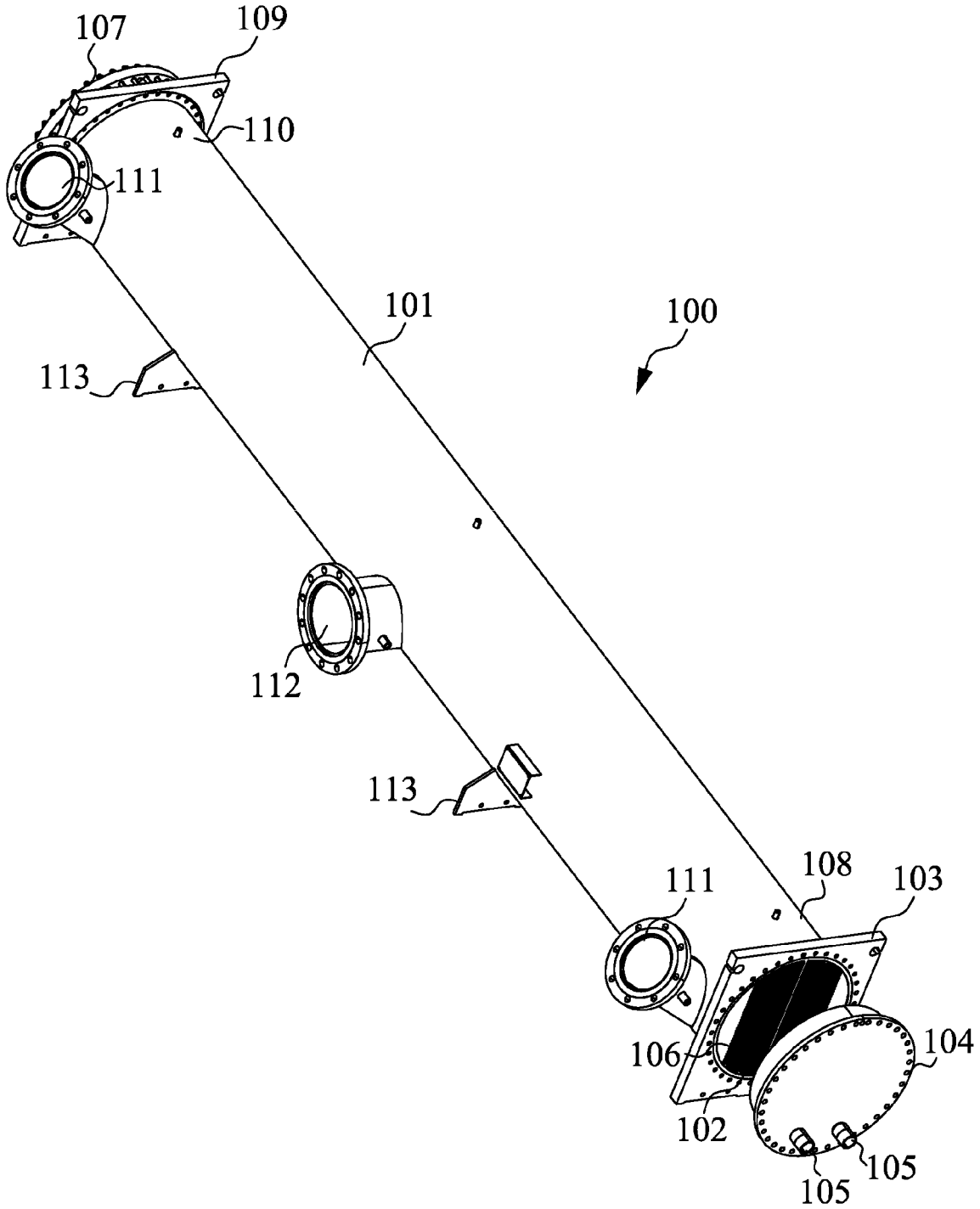
FIG. 1 shows a structure of an evaporator 100 according to an embodiment of the present application.

FIG. 1 shows a structure of an evaporator 100 according to an embodiment of the present application. FIG. 1 shows a structure after a distribution device 104 is separated from a main body of the evaporator 100. As shown in FIG. 1, the evaporator 100 includes an evaporator housing 101, a heat exchange tube set 102, a tube plate 103, an additional tube plate 109 and a distribution device 104. The evaporator housing 101 is in a long cylinder shape, and the long-cylinder-shaped evaporator housing 101 extends in a horizontal direction. An accommodating space is formed inside the evaporator housing 101, and openings are formed at two ends of the length direction of the evaporator housing 101. The tube plate 103 and the additional tube plate 109 are both in a plate shape, and are respectively disposed at the two ends of the length direction of the evaporator housing 101. As shown in FIG. 1, the tube plate 103 is connected to one end 108 of the length direction of the evaporator housing 101, and the additional tube plate 109 is connected to the other end 110 of the length direction of the evaporator housing 101. The tube plate 103 and the additional tube plate 109 have the same shape, are parallel to each other, and are respectively disposed in a manner of being perpendicular to the length direction of the evaporator housing 101. Sizes of the tube plate 103 and the additional tube plate 109 are respectively greater than a size of the opening of the evaporator housing 101 at the corresponding end, so that the tube plate 103 and the additional tube plate 109 can respectively seal the openings at the two ends of the length direction of the evaporator housing 101.

Figure 2B:
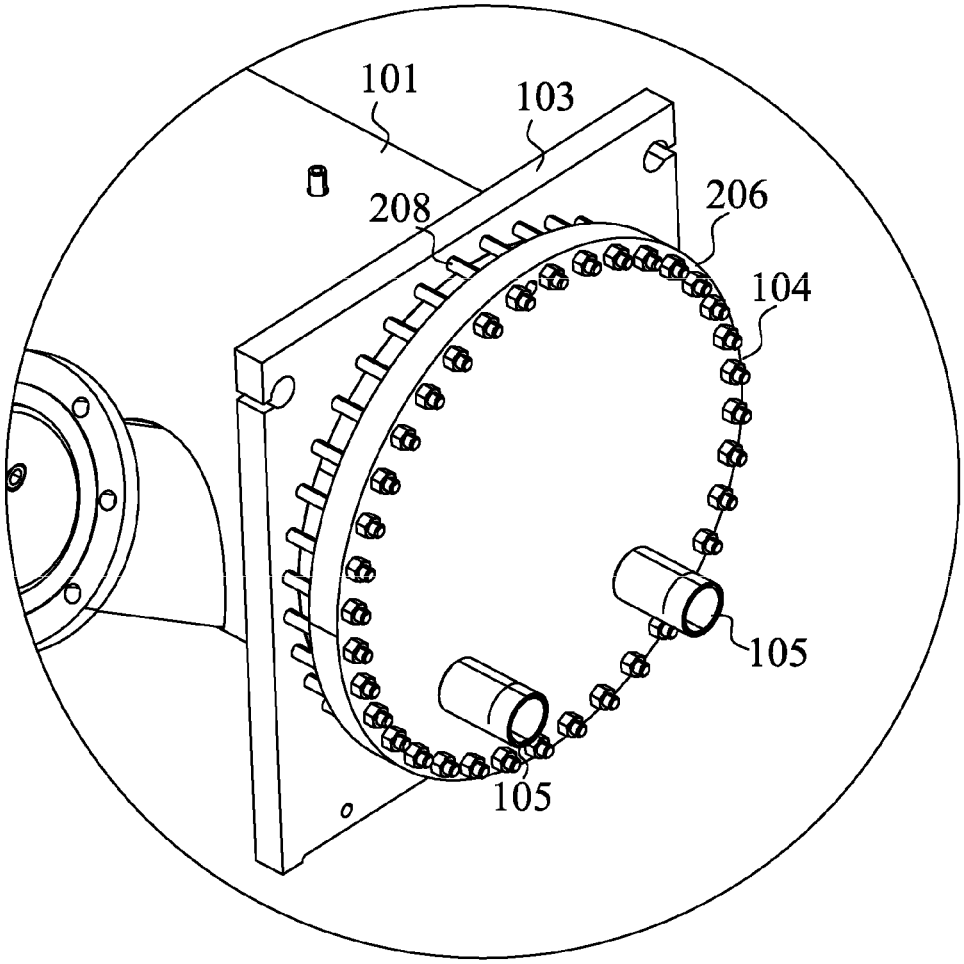
FIG. 2B shows a stereo structural diagram of a front view after the distribution device 104 in FIG. 2A is installed with a tube plate 103.
Figure 3:
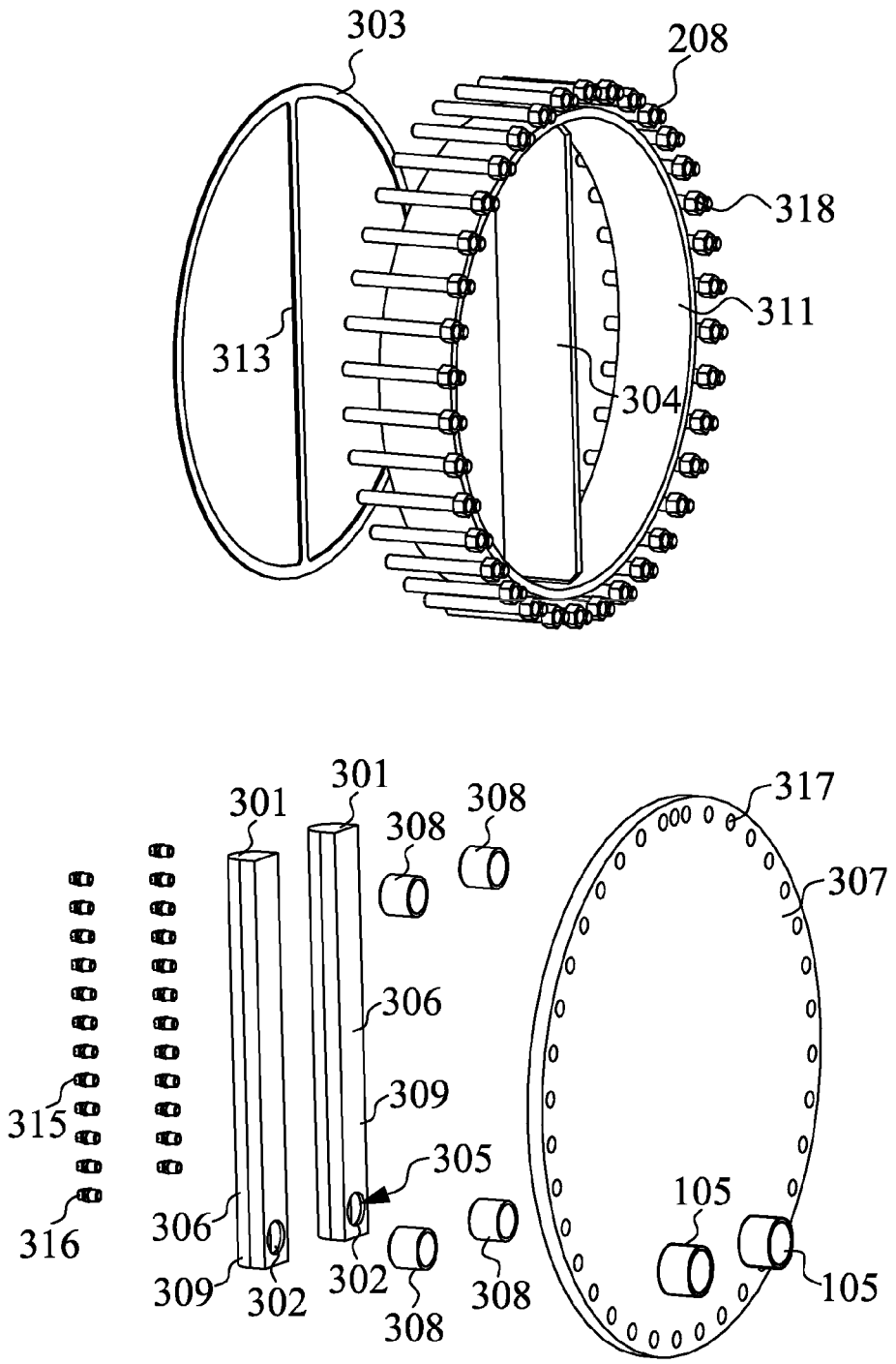
FIG. 3 is an exploded view of the distribution device 104 in FIG. 2A.

The heat exchange tube set 102 is disposed in the accommodating space of the evaporator housing 101, and the length direction of the heat exchange tube set 102 is the same as the length direction of the evaporator housing 101. The distribution device 104 is located at one end 108 of the length direction of the evaporator housing 101, and is connected to an outer side of the tube plate 103. As shown in FIG. 1, the distribution device 104 includes a receiving port 105, and the receiving port 105 is configured to receive a refrigerant from an expansion valve, so that the distribution device 104 can distribute the refrigerant into the heat exchange tube set 102. The distribution device 104 of the present embodiment includes two receiving ports 105. In other embodiments, other quantities of the receiving ports 105 may be included, for example, one, three, etc. In the present embodiment, the distribution device 104 further includes fasteners 208 (as shown in FIG. 2B and FIG. 3), and the distribution device 104 may be fixedly connected onto the tube plate 103 through the fasteners 208. In other embodiments, the distribution device 104 may be fixedly connected with the tube plate 103 in other connection manners such as welding. In order to show a structure of the side of the tube plate 103 facing the distribution device 104, FIG. 1 shows a structure after the distribution device 104 is separated from the main body of the evaporator 100, and the fasteners 208 configured to fix the distribution device 104 are omitted.

An outer side of the additional tube plate 109 is provided with an output end 107, the output end 107 may communicate with the heat exchange tube set 102 in the evaporator housing 101, so that the refrigerant in the heat exchange tube set 102 may be discharged out of the evaporator 100 through the output end 107. A side surface of the evaporator housing 101 is provided with a water inlet 111 and a water outlet 112, the water inlet 111 and the water outlet 112 respectively communicate with the accommodating space in the evaporator housing 101, so that water can flow into the evaporator housing 101 from the water inlet 111, and flow out from the water outlet 112. The evaporator 100 of the present embodiment includes two water inlets 111 and one water outlet 112. As shown in FIG. 1, the two water inlets 111 are respectively disposed in two opposite ends of the length direction of the evaporator housing 101, and the water outlet 112 is disposed in a middle position of the length direction of the evaporator housing 101. In other embodiments, the evaporator 100 may also include one water inlet 111 and one water outlet 112.

Two support frames 113 are disposed at the bottom of the evaporator housing 101, and the two support frames 113 are disposed in parallel to support the evaporator 100 to be horizontally disposed on a horizontal plane. In the present embodiment, the tube plate 103 and the additional tube plate 109 are respectively rectangular plates, and the respective bottom edges of the rectangular plates are flush with the horizontal plane, so that the tube plate 103 and the additional tube plate 109 may achieve an auxiliary support effect on the evaporator 100 installed on the horizontal plane. In other embodiments, the tube plate 103 and the additional tube plate 109 may also be set to present other shapes as long as they can seal the openings of the evaporator housing 101 at the corresponding side.

Figure 2A:
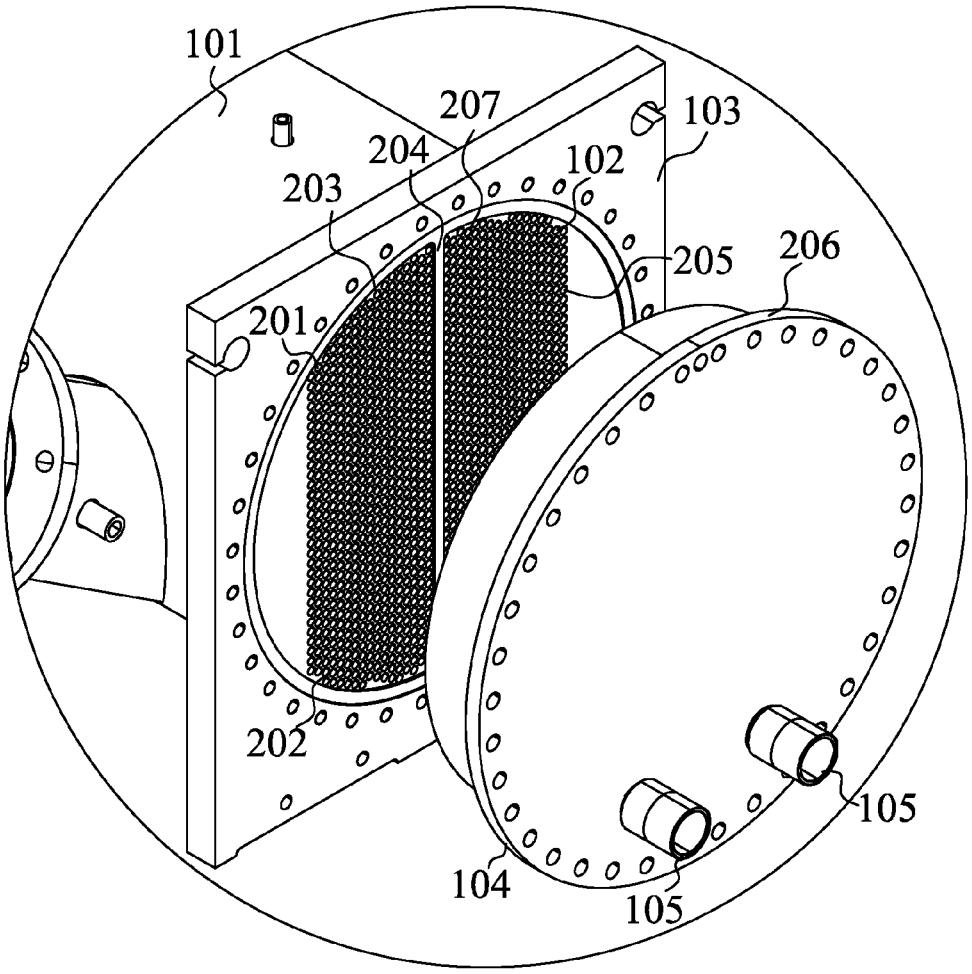
FIG. 2A is an enlarged diagram of the evaporator 100 in FIG. 1 at a position of a distribution device 104.

FIG. 2A is an enlarged diagram of the evaporator 100 in FIG. 1 at a position of the distribution device 104. FIG. 2B shows a stereo structural diagram of a front view after the distribution device 104 in FIG. 2A is installed with a tube plate 103. As shown in FIG. 2A and FIG. 2B, the distribution device 104 includes a distribution device housing 206, and a cross section of the distribution device housing 206 is generally in a round shape. The two receiving ports 105 are both in a tubular shape, are disposed in the distribution device housing 206, and communicate with the inside of the distribution device housing 206, so that the refrigerant from the outside of the distribution device housing 206 may enter the distribution device housing 206 respectively through the two receiving ports 105. A plurality of fasteners 208 are disposed around the periphery of the distribution device housing 206, and the distribution device housing 206 is fixedly connected with the tube plate 103 through the fasteners 208.

As shown in FIG. 2A, the heat exchange tube set 102 includes a plurality of heat exchange tubes 201, and each of the heat exchange tubes 201 respectively extends in the length direction of the evaporator housing 101. The plurality of heat exchange tubes 201 penetrate through the tube plate 103 in the respective extending direction, and form a plurality of heat exchange tube inlets 205 on the tube plate 103. In the present embodiment, the plurality of heat exchange tube inlets 205 are flush with an outer surface of the tube plate 103. The plurality of heat exchange tube inlets 205 faces towards the distribution device 104, so that the distribution device 104 may distribute the refrigerant to the plurality of heat exchange tubes 201.

Additionally, by referring to FIG. 1, it can be learned that the water inlets 111 through which water flows into the evaporator 100 and the water outlet 112 through which water flows out of the evaporator 100 are respectively disposed in the evaporator housing 101, so that the tube plate 103, the additional tube plate 109, the evaporator housing 101 and tube walls of the plurality of heat exchange tubes 201 jointly define a water flowing space, and water flows between the inside of the evaporator housing 101 and the outsides of the plurality of heat exchange tubes 201. The water flowing into the evaporator housing 101 flows outside the heat exchange tube set 102, and the refrigerant flows inside the plurality of heat exchange tubes 201, so that the refrigerant flowing inside the heat exchange tube set 102 can exchange heat with the water flowing outside the heat exchange tube set 102.

In the present embodiment, the plurality of heat exchange tubes 201 form tow heat exchange tube sub sets 202, which are respectively a first heat exchange tube sub set 203 and a second heat exchange tube sub set 207. The first heat exchange tube sub set 203 and the second heat exchange tube sub set 207 are symmetrically disposed at the left side and the right side of the evaporator housing 101, an interval 204 is formed between the first heat exchange tube sub set 203 and the second heat exchange tube sub set 207, and the interval 204 extends in a vertical direction. When the evaporator 100 is in a work state, the first heat exchange tube sub set 203 and the second heat exchange tube sub set 207 may operate at the same time, and may respectively operate independently. That is, the evaporator 100 may have three work states, in the first work state, only the first heat exchange tube sub set 203 operates; in the second work state, only the second heat exchange tube sub set 207 operates; and in the third work state, the first heat exchange tube sub set 203 and the second heat exchange tube sub set 207 operate at the same time. The specific work state of the first heat exchange tube sub set 203 and the second heat exchange tube sub set 207 may be selected according to the requirements of users. In some embodiments, the heat exchange tube set 102 may be formed into a whole and may not work in a grouped manner. In some other embodiments, the heat exchange tube set 102 may also be separated into other quantities of heat exchange tube sub sets 202, for example, three, four, etc., so that each heat exchange tube sub set 202 can operate independently.

FIG. 3 is an exploded view of the distribution device 104 in FIG. 2A. The distribution device 104 includes a distribution device housing 206, receiving ports 105, fasteners 208, distribution members 301 and a sealing ring 303. As shown in FIG. 3, the distribution device housing 206 includes an end plate 307 and an annular baffle plate 311. The end plate 307 is in a round plate shape, and a plurality of fastener installing holes 317 are formed in an edge position of the end plate. The plurality of fastener installing holes 317 form a ring shape around an inner edge of the end plate 307 to cooperate with the installation of the fasteners 208. In the present embodiment, the fasteners 208 include a plurality of screw bolts 318, and the fastener installing holes 317 are round holes matched with the screw bolts. The two receiving ports 105 are disposed in an outer surface of the end plate 307, and the two receiving ports 105 respectively penetrate through a thickness direction of the end plate 307. In the present embodiment, the two receiving ports 105 are symmetrically disposed with respect to a center axis in the vertical direction of the end plate 307, and the two receiving ports 105 are both located at a lower portion of the end plate 307.

The annular baffle plate 311 is in an annular shape, and has a certain thickness, and openings are respectively formed in two ends of the thickness direction. In order to meet the respective independent operation requirement of the two heat exchange tube sub sets 202 in the present embodiment, the annular baffle plate 311 is internally provided with a separation plate 304. The separation plate 304 extends in the vertical direction, and is located in a symmetrical center of the annular baffle plate 311. The two ends of the separation plate 304 in the length direction are respectively connected with an inner wall of the annular baffle plate 311, so that an inside space of the annular baffle plate 311 is separated into two symmetrical sub regions to be matched with the structure arrangement of two sub sets of the heat exchange tube set 102. In other embodiments, corresponding to other quantities of the heat exchange tube sub sets 202, the separation plate 304 may also be made to other structures to separate the inside space of the annular baffle plate 311 into a plurality of sub regions matched with the plurality of heat exchange tube sub sets 202. For embodiments in which the heat exchange tube set 102 is not separated into a plurality of sub sets, the distribution device 104 may be provided with no separation plate 304 in the annular baffle plate 311.

The sealing ring 303 is integrally in an annular shape, made of an elastic material, and configured to achieve a sealed connection effect between the annular baffle plate 311 and the tube plate 103. The size and shape of the sealing ring 303 are matched with a cross section of an end portion of one side of the annular baffle plate 311 near the tube plate 103. In the present embodiment, in order to be matched with the separation plate 304 disposed inside the annular baffle plate 311, a sealing strip 313 is disposed inside the sealing ring 303. The sealing strip 313 can achieve the sealed connection between the separation plate 304 and the tube plate 103.

The distribution device 104 of the present embodiment includes two distribution members 301. In other embodiments, other quantities of the distribution members 301 may be included, for example, one, three, four, etc. As shown in FIG. 3, the distribution member 301 is formed by a distribution tube 306. In the present embodiment, the distribution tube 306 includes a distribution tube body 309 and a plurality of spray nozzles 315. The distribution tube body 309 is in a tubular shape, two ends of the distribution tube body 309 in the length direction are respectively provided with a distribution tube end plate, so that a distribution accommodating cavity 305 capable of storing a refrigerant can be formed inside the distribution tube body 309. A refrigerant inlet 302 is formed in the distribution tube body 309, and the refrigerant inlet 302 communicates with the distribution accommodating cavity 305, so that the refrigerant can enter the distribution accommodating cavity 305 through the refrigerant inlet 302. The plurality of spray nozzles 315 are disposed on a tube wall of the side, opposite to the refrigerant inlet 302, of distribution tube body 309. Each of the spray nozzles 315 can form a distribution port 316, and a plurality of distribution ports 316 communicate with the distribution accommodating cavity 305, so that the refrigerant stored in the distribution accommodating cavity 305 can be outwards sprayed through the plurality of distribution ports 316.

The distribution device 104 further includes a plurality of support members 308, the plurality of distribution tubes 306 may be installed on the end plate 307 through the plurality of support members 308. As shown in FIG. 3, corresponding to the two distribution tubes 306 in the present embodiment, four support members 308 are disposed in the distribution device 104. The plurality of support members 308 are in a tubular shape, and are connected between the corresponding distribution tube 306 and the end plate 307. As shown in FIG. 3, each of the distribution tubes 306 is provided with two support members 308, and the two support members 308 are respectively located at two end portions of the distribution tube 306 in the length direction, so that each distribution tube 306 is installed onto the end plate 307 through two support members 308. The refrigerant inlet 302 of one corresponding distribution tube 306 communicates with one corresponding receiving port 105 through each support member 308 of the two support members 308, so that the distribution tube 306 can obtain the refrigerant from the receiving port 105 through the support member 308 connected with the refrigerant inlet 302. The four support members 308 in the distribution device 104 have the same length, additionally, the two distribution tubes 306 are respectively parallel to the end plate 307, and the two distribution tubes 306 are respectively disposed in the vertical direction. In the present embodiment, the plurality of support members 308 are fixedly connected between the corresponding distribution tube 306 and the end plate 307 through a welding process, and in other embodiments, other connection processes may also be adopted. In some other embodiments, no support member 308 may be disposed in the distribution device 104, and the distribution member 301 is directly connected with the end plate 307.

Figure 4:
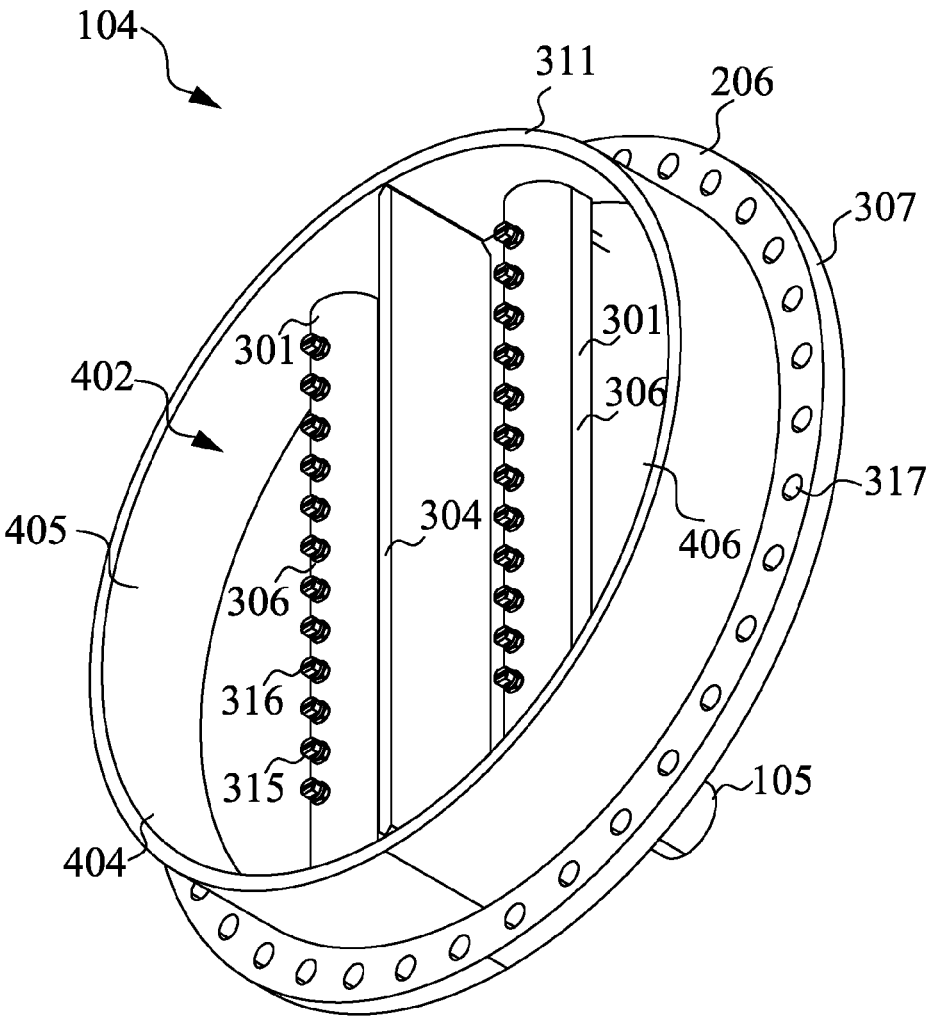
FIG. 4 shows a stereo structural diagram of a back view of the distribution device 104 in FIG. 2A.

FIG. 4 shows a stereo structural diagram of a back view of the distribution device 104 in FIG. 2A. As shown in FIG. 4, the end plate 307 is connected to one end of the thickness direction of the annular baffle plate 311, and the distribution device housing 206 is jointly formed by the annular baffle plate 311 and the end plate 307. The size of the end plate 307 is larger than the opening size of the annular baffle plate 311, so that the end plate 307 may seal one opening of the annular baffle plate 311 from one end of the thickness direction of the annular baffle plate 311. The annular baffle plate 311 is fixed onto an inner surface of the end plate 307, and the annular baffle plate 311 and the end plate 307 jointly form an accommodating space 402 of the distribution device 104.

The accommodating space 402 of the distribution device housing 206 is separated into two sub accommodating spaces 404 by the separation plate 304 disposed at the inner side of the annular baffle plate 311, and the two sub accommodating spaces are respectively a first sub accommodating space 405 and a second sub accommodating space 406. The two distribution tubes 306 are respectively disposed in the first sub accommodating space 405 and the second sub accommodating space 406. As shown in FIG. 4, the two distribution tubes 306 both extend in an approximately vertical direction, and two ends of each distribution tube 306 in the length direction are respectively connected with the inner wall of the annular baffle plate 311. In the present embodiment, the distribution tube 306 per se is provided with a distribution tube plate at the end portion so as to form a sealed structure. In other embodiments, the sealed structures at the two ends of the distribution tube 306 are jointly formed by the inner wall of the annular baffle plate 311 and the distribution tube 306, so after the distribution tube 306 is installed to the accommodating space 402 of the distribution device 104, the distribution tube 306 can store the refrigerant through the sealed structures at the two ends of the length direction. The refrigerant inlet 302 of each distribution tube 306 is disposed in a manner of facing towards the end plate 307, and is configured to receive the refrigerant from the receiving port 105. The plurality of distribution ports 316 of each distribution tube 306 are disposed in parallel in the length direction of the distribution tube 306, and intervals are formed among the plurality of distribution ports 316.

In combination with FIG. 2B, FIG. 3 and FIG. 4, it can be seen that when the distribution device housing 206 is installed on the tube plate 103 through the screw bolts 318, the distribution device housing 206 is disposed around the heat exchange tube inlets 205. One end of the screw bolt 318 penetrates through the fastener installing hole 317 on the end plate 307, and the other end is connected with the tube plate 103. The annular baffle plate 311 is located between the tube plate 103 and the end plate 307. The plurality of screw bolts 318 are disposed around the outer side of the annular baffle plate 311. Under the fastening effect of the screw bolts 318, the annular baffle plate 311 is abutted against the outer surface of the tube plate 103 through the sealing ring 303 by receiving the pressure of the end plate 307, and the annular baffle plate 311 and the tube plate 103 jointly seal the heat exchange tube inlets 205 at the outer periphery of the heat exchange tube inlets 205. At this moment, the first sub accommodating space 405 faces towards the first heat exchange tube sub set 203, the second sub accommodating space 406 faces towards the second heat exchange tube sub set 207, the separation plate 304 is aligned with the interval 204 between the first heat exchange tube sub set 203 and the second heat exchange tube sub set 207. The plurality of distribution ports 316 on each distribution tube 306 all face towards the heat exchange tube inlet 205 of the heat exchange tube set 102, and the plurality of distribution ports 316 form a certain distance away from the plurality of heat exchange tube inlets 205, so that the distribution tube 306 located in the first sub accommodating space 405 can spray the refrigerant towards the first heat exchange tube sub set 203, and the distribution tube 306 located in the second sub accommodating space 406 can spray the refrigerant towards the second heat exchange tube sub set 207. The two ends of the distribution tubes 306 are connected to the inner wall of the distribution device housing 206, and the distribution tubes 306 upwards extend in the whole height direction in the distribution device housing 206, so that the spraying direction of the distribution tube 306 can cover the whole height of the plurality of heat exchange tube inlets 205, so that the heat exchange tubes 201 installed at different heights in the evaporator 100 can be sprayed with the refrigerant from the distribution device 104.

Figure 5:
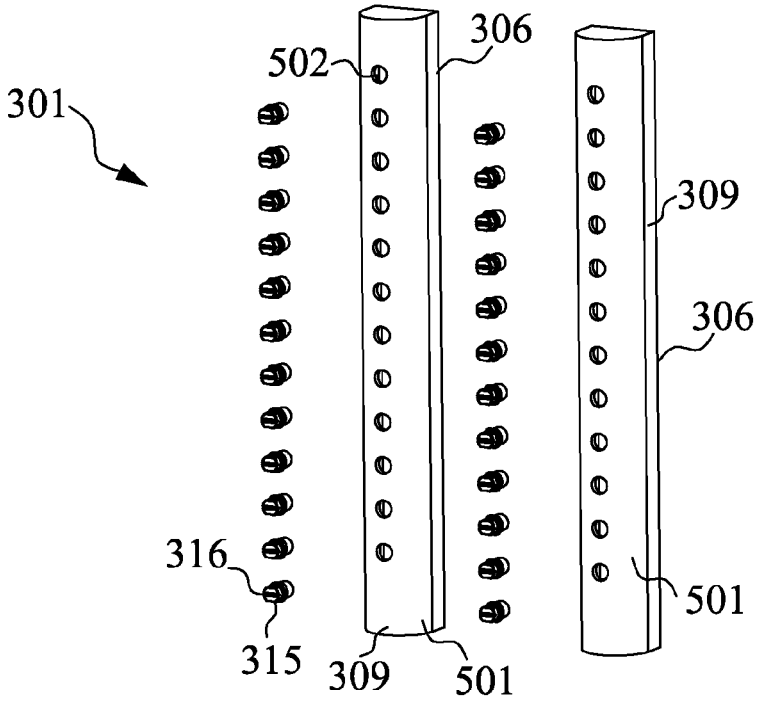
FIG. 5 shows an exploded view of a distribution member 301 in FIG. 4.

FIG. 5 shows an exploded view of the distribution member 301 in FIG. 4. As shown in FIG. 5, the distribution tube 306 for forming the distribution member 301 is in a long strip shape, and a random cross section of the long-strip-shaped distribution tube 306 is approximately in an arch shape. Each distribution tube body 309 includes a distribution surface 501 disposed in a manner of facing towards the tube plate 103, and the distribution surface 501 extends in the length direction of the distribution tube body 309. The distribution surface 501 is a bent arc-shaped surface, and its bending direction is the same as the extending direction of the distribution tube body 309. A plurality of spray nozzle installing holes 502 are formed in the distribution surface 501, the plurality of spray nozzle installing holes 502 are disposed in parallel in the length direction of the distribution surface 501, and the plurality of spray nozzles 315 are disposed on the distribution tube body 309 through the spray nozzle installing holes 502. In the present embodiment, the plurality of spray nozzles 315 are connected onto the distribution tube body 309 through screw threads. In other embodiments, the spray nozzles 315 may also be fixed onto the distribution tube body 309 in other manners.

As shown in FIG. 5, the distribution ports 316 formed through the spray nozzles 315 are in a long strip shape. When the plurality of spray nozzles 315 are installed into the corresponding spray nozzle installing holes 502, each distribution port 316 extends in the width direction of the distribution tube 306. Through the arrangement of the distribution ports 316 in the width direction of the distribution tubes 306, the refrigerant sprayed out from the distribution ports 316 may be diffused in the width direction of the distribution tubes 306. In the present embodiment, the refrigerant spraying in the width range of the corresponding heat exchange tube sub set 202 can be covered by installing one distribution tube 306 in each sub accommodating space 404 of the accommodating space 402 of the distribution device. In other embodiments, if the refrigerant sprayed by one distribution tube 306 cannot meet the spraying requirements of the whole width range in the corresponding heat exchange tube sub set 202, a plurality of distribution tubes 306 may be disposed in parallel in the width direction of the corresponding sub accommodating space 404 in the distribution device 104. That is, the refrigerant sprayed out from the distribution device 104 of the present embodiment can cover the plurality of refrigerant inlets 302 distributed on the tube plate 103.

Figure 6:
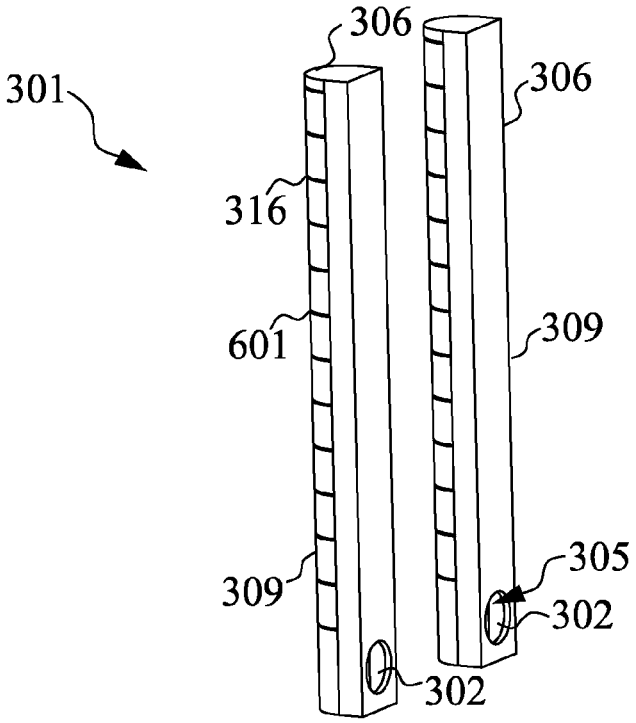
FIG. 6 shows a stereo structural diagram of a distribution member 301 according to another embodiment.

FIG. 6 shows a stereo structural diagram of the distribution member 301 according to another embodiment. Similar to the structure of the distribution member 301 formed by the distribution tube 306 in FIG. 3 to FIG. 5, the distribution member 301 shown in FIG. 6 is also formed by the distribution tube 306. The distribution tube 306 in FIG. 6 is also in a long tubular shape with an arch-shaped cross section, the distribution accommodating cavity 305 is formed inside the distribution tube 306, a refrigerant inlet 302 and a plurality of distribution ports 316 are relatively formed in a tube wall of the distribution tube 306, and the refrigerant inlet 302 and the plurality of distribution ports 316 respectively communicate with the distribution accommodating cavity 305. Different from FIG. 3 to FIG. 5 in which each distribution tube 306 includes a plurality of spray nozzles 315 and the distribution tube body 309, and the plurality of distribution ports 316 are formed by additionally installing a plurality of spray nozzles 315 on the distribution tube body 309, the distribution tube 306 shown in FIG. 6 is formed by the distribution tube body 309, and the plurality of distribution ports 316 are formed by a plurality of cuts 601 formed in the tube wall of the distribution tube 306. As shown in FIG. 6, the plurality of cuts 601 penetrate through the tube wall of the distribution tube 306 so as to communicate with the distribution accommodating cavity 305 in the distribution tube 306. The plurality of cuts 601 are disposed in the arc-shaped distribution surface 501 of the distribution tube 306, and the plurality of cuts 601 are disposed at intervals in the length direction of the distribution surface 501. Each cut 601 is in a long strip shape, and extends in the circumferential direction in the width direction of the distribution tube 306. An installation structure of the distribution tube 306 on the distribution device housing 206 in FIG. 6 has the same installation manner as the distribution tube 306 in the distribution device 104 in FIG. 4. When the distribution tube 306 is installed in the distribution device housing 206, the length direction of the distribution tube 306 is the same as the height direction of the evaporator housing 101, so that the plurality of distribution ports 316 are disposed at intervals in the vertical direction, and each distribution port 316 approximately extends in the width direction of the evaporator housing 101. Through the above arrangement, the plurality of distribution ports 316 can realize spraying from different heights, and the refrigerant sprayed out from each distribution port 316 can be diffused in the width direction of the evaporator housing 101. Therefore, it can be seen that like the distribution member 301 shown in FIG. 3 to FIG. 5, the distribution member 301 in FIG. 6 can meet the spraying requirements of the heat exchange tubes 201 in different heights and different width directions at the same time.

In combination with FIG. 5 and FIG. 6, it can be seen that the distribution ports 316 and the refrigerant inlet 302 are respectively located in two adjacent side surfaces of the distribution tube 306. When the refrigerant enters the distribution accommodating cavity 305 in the distribution tube 306 from the refrigerant inlet 302 at the right side of the distribution tube 306, the refrigerant may be sprayed out from the distribution port 316 at the left side of the distribution tube 306. In the embodiment shown in FIG. 5, the sizes and shapes of the plurality of distribution ports 316 on the distribution tube 306 are completely identical. If one distribution port 316 is disposed opposite to the refrigerant inlet 302, the refrigerant sprayed out from this distribution port 316 has a higher spraying speed than the refrigerant sprayed out from other distribution ports 316. This is because the distribution port 316 disposed opposite to the refrigerant inlet 302 is nearest to the refrigerant inlet 302, and the energy loss is smallest when the refrigerant moves to the distribution port 316 from the refrigerant inlet 302. In order to relatively balance the refrigerant spraying speed among the distribution ports 316 so that the heat exchange tubes 201 at different heights can obtain relatively equal refrigerant spraying amount, no distribution port 316 is provided in one side, opposite to the refrigerant inlet 302, of the distribution tube 306 according to the present application.

Figure 7:
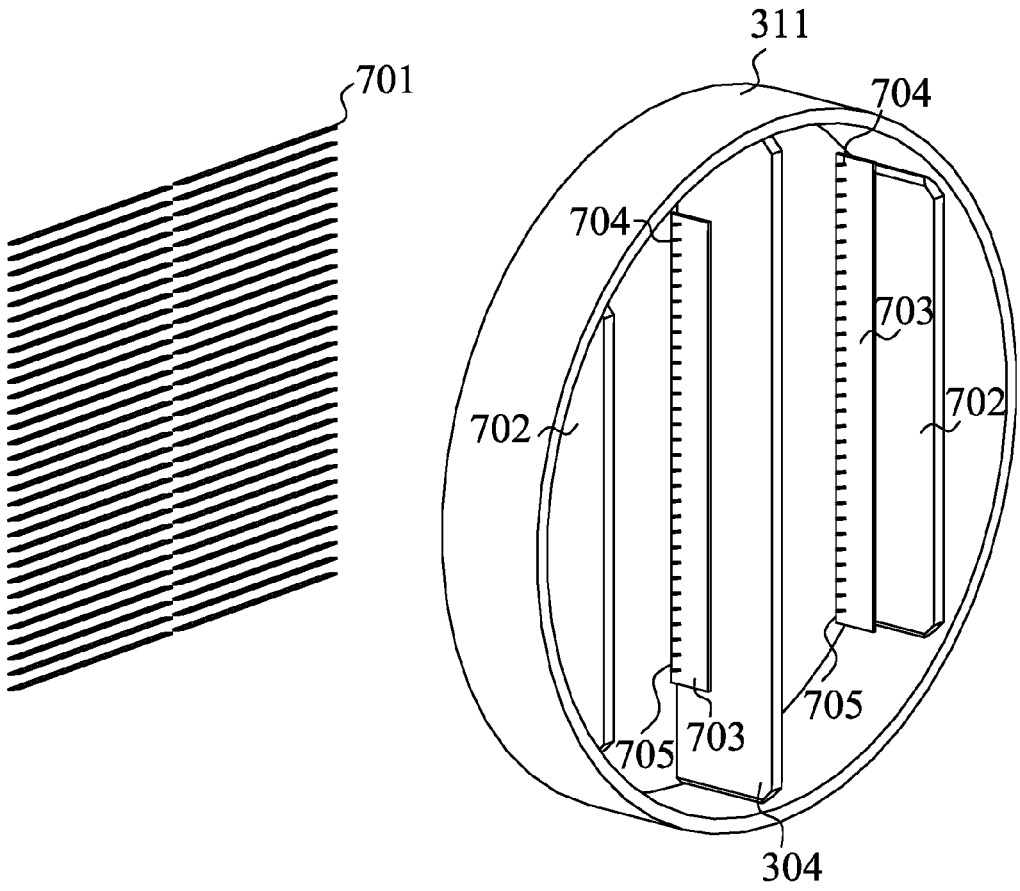
FIG. 7 shows a structure of a plurality of flow deflectors 701 and an annular baffle plate 311 matched therewith in another embodiment of the distribution device.

FIG. 7 shows a stereo structural diagram of a plurality of flow deflectors 701 and an annular baffle plate 311 matched therewith in another embodiment of the distribution device. Under the influence of gravity, the refrigerant sprayed out from the distribution ports 316 at higher positions of the distribution tube 306 may scatter in an obliquely downward direction. In order to prevent the excessive refrigerant from being sprayed to the heat exchange tube 201 at the bottom of the evaporator housing 101, in some embodiments, the distribution device 104 may also include a plurality of flow deflectors 701. The plurality of flow deflectors 701 are disposed in the accommodating space 402 formed by the distribution device housing 206, and are located among the tube plate 103 and the plurality of distribution members 301. In order to be matched with the two distribution tubes 306 in this embodiment of the present application, two lines of flow deflectors 701 are disposed in FIG. 7. The two lines of flow deflectors 701 are disposed in parallel in the width direction of the evaporator housing 101, and each line of flow deflectors 701 are disposed at the outer side of the distribution surface 501 of one corresponding distribution tube 306, and are disposed at intervals in the length direction of the distribution surface 501. As shown in FIG. 7, the plurality of flow deflectors 701 in the same line are disposed in a manner of being parallel to each other, and intervals between every two adjacent flow deflectors 701 in the vertical direction are identical. A spraying region of the distribution tubes 306 is separated into a plurality of sub regions by the plurality of flow deflectors 701 disposed at intervals in the vertical direction, the plurality of spraying sub regions cannot be directly communicated in the vertical direction, the refrigerant is prevented from falling into the lower spraying sub regions from the higher spraying sub regions to be gathered in a lower portion of the evaporator housing 101, and each heat exchange tube 201 at different height is enabled to obtain approximately equal refrigerant flow-in amount from the corresponding heat exchange tube inlets 205.

As shown in FIG. 7, each flow deflector 701 extends in an obliquely upward direction relative to the outer surface of the tube plate 103. An included angle of each flow deflector 701 and the horizontal direction is smaller than or equal to 15°. In some embodiments, the included angle may also be smaller than or equal to 10°. In some embodiments, each flow deflector 701 may be set to be perpendicular to the tube plate 103. Through the structures of the flow deflectors 701 perpendicular to the tube plate 103 or disposed in an obliquely upward direction from the tube plate 103, the normal spraying of the refrigerant can be ensured while separating the spraying region of the distribution tubes 306, and the refrigerant sprayed out from the distribution tube 306 is prevented from flowing back to the positions of the distribution ports 316 through being guided by the flow deflectors 701.

In order to install the two lines of flow deflectors 701 into the distribution device 104, two installation plates 702 and four insertion connectors 703 are additionally disposed in the annular baffle plate 311 according to the present embodiment. The two installing plates 702 are in a batten shape, and are respectively located at the left side and the right side of the separation plate 304. The two installation plates 702 are disposed in a manner of being parallel to the separation plate 304, and the two distribution tubes 306 can be respectively disposed between the separation plate 304 and the corresponding one installation plate 702.

In the present embodiment, the two installation plates 702 are respectively located in positions near edges of the annular baffle plate 311. The interval between each installation plate 702 and the separation plate 304 is approximately the same as the length of the flow deflector 701, so that each line of flow deflectors 701 may be installed between the separation plate 304 and the corresponding one installation plate 702. The four insertion connectors 703 are in a pairwise opposite manner, are respectively disposed at two opposite sides of each installation plate 702 and the separation plate 304, and are configured to respectively install the two lines of flow deflectors 701 between the separation plate 304 and the corresponding one installation plate 702. In the present embodiment shown in FIG. 7, the four insertion connectors 703 are fixed into the separation plate 304 and the corresponding installation plates 702 in a welding manner. Only two insertion connectors 703 are shown in the annular baffle plate 311 in FIG. 7, and are respectively the insertion connector 703 disposed on one side surface of the separation plate 304 and the insertion connector 703 disposed on one installation plate 702 of the two installation plates 702.

The four insertion connectors 703 have approximately identical structures, and are all disposed at one side of the annular baffle plate 311 near the tube plate 103. Each insertion connector 703 extends in the length direction of the separation plate 304 or the corresponding installation plate 702. An outer edge 705 of each insertion connector 703 is flush with an outer edge of the separation plate 304 or the corresponding installation plate 702 facing towards the tube plate 103. A plurality of insertion connection openings 704 are formed in positions of the outer edge 705 of each insertion connector 703, and the plurality of insertion connection openings 704 are disposed at intervals in the length direction of the insertion connector 703. Each insertion connection opening 704 extends in an obliquely upward direction from the outer edge 705 of the insertion connector 703 to form a groove. An inclination angle of the insertion connection opening 704 is the same as an inclination angle of the flow deflector 701 after installation, and an opening thickness of the insertion connection opening 704 is the same as the thickness of the flow deflector 701, so that the flow deflector 701 may be inserted into the insertion connection opening 704 to be installed onto the annular baffle plate 311 through the connection with the insertion connector 703. The extending length of the insertion connection opening 704 is the same as the length of the flow deflector 701, so that when the flow deflector 701 is inserted and connected to the bottom end of the insertion connection opening 704, the outer edge of the flow deflector 701 is flush with a plane in which the end portion of one corresponding side of the annular baffle plate 311 is located. Therefore, through the arrangement of the plurality of flow deflectors 701 in the distribution device 104, the outer edges of the plurality of flow deflectors 701 are abutted against the outer surface of the tube plate 103, and the inner edges of the plurality of flow deflectors 701 are abutted against the distribution surface 501 of the distribution tube 306. The plurality of flow deflectors 701 extending in the horizontal direction can separate a space between the distribution tubes 306 and the tube plate 103 into a plurality of sub regions in parallel arrangement in the vertical direction. In the embodiment as shown in FIG. 7, the plurality of flow deflectors 701 are fixed into the corresponding insertion connector 703 in a spot welding manner. In other embodiments, other fixed connection manners may also be adopted.

In combination with FIG. 1 to FIG. 7, it can be seen that the distribution device 104 distributes the refrigerant to the plurality of heat exchange tubes 201 in a spraying manner. In an operation process of the evaporator 100, the refrigerant from the expansion valve enters the distribution accommodating cavity 305 of the distribution tube 306 through the receiving ports 105, and the refrigerant entering the distribution accommodating cavity 305 is sprayed towards the tube plate 103 through the plurality of distribution ports 316.

A part of refrigerant sprayed out from the distribution ports 316 just enters the heat exchange tube inlets 205, and enters the corresponding heat exchange tubes 201 directly through the heat exchange tube inlets 205. Additionally, a part of refrigerant from the distribution ports 316 is sprayed onto the tube plate 103 among the plurality of heat exchange tube inlets 205. The refrigerant sprayed onto the tube plate 103 may downwards flow along the wall surface of the tube plate 103 until flows into the lower adjacent heat exchange tube inlet 205, and enters the corresponding heat exchange tube 201 along the heat exchange tube inlet 205. Therefore, in a spraying manner, almost all refrigerant from the distribution device 104 may enter the plurality of heat exchange tubes 201 of the heat exchange tube set 102.

The distribution tubes 306 in the embodiments of the present application are in vertical arrangement, and the plurality of distribution ports 316 are disposed at intervals in the vertical direction. Only when the whole distribution accommodating cavity 305 of the distribution tube 306 is fully filled with the refrigerant, the refrigerant can be sprayed out from the distribution ports 316 at the top end of the distribution tube 306. Under the influence of the pressure intensity of the refrigerant, the refrigerant sprayed out from the distribution ports 316 at the lower portion of the distribution tube 306 has higher spraying speed than the refrigerant sprayed out from the distribution ports 316 at the upper portion of the distribution tube 306, so that the heat exchange tube 201 located at the lower portion of the evaporator housing 101 has a greater refrigerant flow rate than the heat exchange tube 201 located at the upper portion of the evaporator housing 101. Additionally, under the effect of gravity, the refrigerant sprayed out from the distribution ports 316 is downwards scattered, so that the refrigerant is downwards gathered in the spraying process. That is, under the same spraying conditions, the heat exchange tubes 201 located at the lower portion of the evaporator housing 101 may generally obtain a greater refrigerant spraying amount.

In order that the heat exchange tubes 201 at different heights in the evaporator housing 101 may obtain the relatively equal refrigerant spraying amount, in some embodiments, the distribution device 104 sets the length of the support members 308 at higher positions of the distribution tube 306 to be greater than the length of the support members 308 at lower positions of the distribution tube 306, so that the distribution ports 316 located at higher positions of the distribution tube 306 are closer to the tube plate 103 than the distribution ports 316 located at lower positions of the distribution tube 306. Under this structure arrangement, the heat exchange tube inlets 205 of the heat exchange tubes 201 located at higher positions in the evaporator housing 101 are closer to the distribution ports 316, and thus can more easily obtain the refrigerant from the distribution ports 316. In some embodiments, the distribution device 104 sets the openings of the plurality of distribution ports 316 to outwards extend in an obliquely upward direction from the inner wall of the distribution tube 306, so that the refrigerant in the distribution accommodating cavity 305 can be sprayed out from the distribution ports 316 at an obliquely upward angle. Through such arrangement, the heat exchange tubes 201 located at higher positions may also easily obtain the refrigerant. In some embodiments, the opening area of the distribution ports 316 located in higher positions of the distribution tube 306 is greater than the opening area of the distribution ports 316 located in lower positions. Through the above opening structure arrangement of the distribution ports 316, the flow rate of the refrigerant sprayed out from the distribution ports 316 at higher positions is increased, so that more refrigerant can flow into the heat exchange tubes 201 located at higher positions. In some other embodiments, the distribution device 104 sets a distance between two adjacent distribution ports 316 located at higher positions to be smaller than a distance between two adjacent distribution ports 316 located at lower positions. That is, according to this embodiment, the plurality of distribution ports 316 have denser distribution in the position of the upper portion of the distribution tube 306. The spraying amount of the refrigerant in the upper portion region of the distribution device 104 is increased through the plurality of densely distributed distribution ports 316, and the refrigerant amount obtained by the heat exchange tubes 201 at higher positions may also be increased. Therefore, according to the plurality of above embodiments, more refrigerant can be sprayed into the heat exchange tubes 201 at higher positions, so that the flow rate of the refrigerant in each heat exchange tube 201 at different positions can be effectively balanced. In some embodiments, the structure features of the distribution device 104 in various embodiments can be adopted at the same time to achieve the uniform distribution of the distribution device 104 on the refrigerant.

If the distribution device 104 having the structure of the present application is not adopted, instead a plurality of communication tubes are provided in the distribution device 104, and the plurality of communication tubes are inserted and connected into the plurality of heat exchange tubes 201 in a one-to-one correspondence manner to transfer the refrigerant, the distribution device 104 of this implementation has a complicated structure and is troublesome to assemble. It should be known that the quantity of the heat exchange tubes 201 is generally more than one hundred. If the plurality of communication tubes are adopted to be inserted and connected to the heat exchange tubes 201 in the one-to-one correspondence manner to transfer the refrigerant, the quantity of the communication tubes required in the distribution device 104 may be relatively greater, so that the structure complexity of the distribution device 104 is greatly increased. On the other hand, a special clamp is needed by an installation process of inserting and connecting the plurality of communication tubes to the heat exchange tubes 201, and the requirement on the skill of workers is very high, so that the installation process of the distribution device 104 is complicated. Additionally, the communication tubes need to be inserted and connected into the heat exchange tubes 201 in the one-to-one correspondence manner, but the diameter of the heat exchange tubes 201 is very small, so that the communication tubes are required to have a very small diameter. When flowing in the communication tubes with relatively small diameter, the refrigerant has great pressure loss. Therefore, in order to uniformly transfer the refrigerant to each heat exchange tube 201, the refrigerant needs to have a great pressure intensity at the inlet positions of the communication tubes to realize the greater pressure difference between inlets and outlets of the communication tubes. However, in order to realize the greater pressure difference between the inlets and the outlets of the communication tubes to meet the uniform distribution of the refrigerant under different work conditions, the expansion valve needs to have a wider adjustable range. That is, the embodiment of the distribution device 104 adopting the plurality of communication tubes inserted and connected into the plurality of heat exchange tubes 201 in the one-to-one correspondence manner has higher work condition requirements on a refrigeration system.

The distribution device 104 of the present application includes at least one built-in distribution member 301, the distribution member 301 uniformly distributes the refrigerant into the plurality of heat exchange tubes 201 in a refrigerant spraying manner, and the heat exchange efficiency of the evaporator is effectively ensured. Compared with the distribution device 104 adopting the plurality of communication tubes inserted and connected into the plurality of heat exchange tubes 201 in the one-to-one correspondence manner to distribute the refrigerant, the distribution device 104 adopting the structure of the present application has a simple structure, and is easy to manufacture and convenient to install. Additionally, the distribution device 104 of the present application can pre-distribute the refrigerant in the length direction of the distribution member 301, which greatly reduces the requirement of the distribution device 104 on the pressure intensity at the receiving ports 105, and the uniform distribution of the refrigerant can be completed without the need of greater pressure intensity at the receiving ports 105. Therefore, the distribution device 104 of the present application provides a larger range of work condition selection for the design of a refrigerant machine unit, and can ensure the uniform distribution of the refrigerant under the low-pressure work condition.

Although only certain features of the present application have been illustrated and described herein, many modifications and changes can be made by those skilled in the art. Therefore, it should be understood that the appended claims are intended to cover all such modifications and changes falling within the scope of the present application.

What is claimed is:

1. An evaporator, wherein the evaporator comprises:

an evaporator housing, the evaporator housing having a length direction;

a tube plate, the tube plate being connected to one end of the length direction of the evaporator housing;

a heat exchange tube set, the heat exchange tube set comprising a plurality of heat exchange tubes, the heat exchange tube set being provided in the evaporator housing, wherein each heat exchange tube of the plurality of heat exchange tubes extends in the length direction of the evaporator housing and is provided with a heat exchange tube inlet penetrating through the tube plate; and a distribution device, the distribution device being connected to the tube plate and configured to distribute a refrigerant to the heat exchange tube inlets, and the distribution device comprising:

a distribution device housing, the distribution device housing being internally provided with an accommodating space, the distribution device housing being disposed around the heat exchange tube inlets and sealing the heat exchange tube inlets;

at least one receiving port, the at least one receiving port being configured to receive the refrigerant; and at least one distribution member, wherein each distribution member is disposed in the accommodating space and comprises a distribution accommodating cavity and a plurality of distribution ports communicating with the distribution accommodating cavity, the distribution accommodating cavity of each distribution member communicates with one corresponding receiving port, and the plurality of distribution ports is disposed towards the heat exchange tube inlets at a certain distance from the heat exchange tube inlets.

2. The evaporator according to claim 1, wherein:

the evaporator housing has a height direction and a width direction; and the at least one distribution member comprises a distribution tube, the distribution tube extends in the height direction of the evaporator housing, and the plurality of distribution ports is distributed at intervals in an extending direction of the distribution tube.

3. The evaporator according to claim 2, wherein:

the plurality of distribution ports is formed by a plurality of cuts in the distribution tube, and each cut of the plurality of cuts extends in a peripheral direction of the distribution tube.

4. The evaporator according to claim 2, wherein:

the plurality of distribution ports is formed by a plurality of spray nozzles disposed on the distribution tube, and each distribution port of the plurality of distribution ports extends in the width direction of the evaporator housing.

5. The evaporator according to claim 2, wherein:

in the extending direction of the distribution tube, a distance between two adjacent distribution ports of the plurality of distribution ports in higher positions is smaller than a distance between two adjacent additional distribution ports of the plurality of distribution ports in lower positions.

6. The evaporator according to claim 1, wherein:

an opening of a distribution port of the plurality of distribution ports is formed in an obliquely upward direction such that the refrigerant in the distribution accommodating cavity is able to be sprayed out from the distribution port at an obliquely upward angle.

7. The evaporator according to claim 1, wherein, in a height direction of the evaporator housing, a first distribution port of the plurality of distribution ports in a higher position is closer to the heat exchange tube inlets than a second distribution port of the plurality of distribution ports in a lower position.

8. The evaporator according to claim 1, wherein:

in a height direction of the evaporator housing, an opening size of a first distribution port of the plurality of distribution ports in a higher position is larger than an opening size of a second distribution port in a lower position.

9. The evaporator according to claim 1, wherein:

the distribution device housing comprises:

an end plate, wherein the at least one distribution member is disposed on an inner wall of the end plate, and the at least one receiving port penetrates through the end plate; and an annular baffle plate, wherein the annular baffle plate is connected between the tube plate and the end plate, and the annular baffle plate forms the accommodating space together with the end plate.

10. The evaporator according to claim 1, wherein, the distribution device further comprises a plurality of flow deflectors, the plurality of flow deflectors is disposed between the tube plate and the at least one distribution member, and the plurality of flow deflectors is disposed at intervals in a height direction of the evaporator housing, wherein each flow deflector of the plurality of flow deflectors respectively extends in an obliquely upward direction from the tube plate, and an included angle between each flow deflector of the plurality of flow deflectors and a horizontal direction is smaller than or equal to 15 degrees.

* * * * *